US007804232B2

(12) United States Patent
Kumagai et al.

(10) Patent No.: US 7,804,232 B2
(45) Date of Patent: Sep. 28, 2010

(54) SPARK PLUG WITH HIGH DURABILITY

(75) Inventors: Kenichi Kumagai, Nagoya (JP); Wataru Matsutani, Nagoya (JP); Kenji Kobayashi, Gamagori (JP)

(73) Assignee: NGK Spark Plug Co., Ltd., Aichi (JP)

( * ) Notice: Subject to any disclaimer, the term of this patent is extended or adjusted under 35 U.S.C. 154(b) by 896 days.

(21) Appl. No.: 10/571,690

(22) PCT Filed: Jan. 27, 2005

(86) PCT No.: PCT/JP2005/001092

§ 371 (c)(1),
(2), (4) Date: Mar. 13, 2006

(87) PCT Pub. No.: WO2005/071809

PCT Pub. Date: Aug. 4, 2005

(65) Prior Publication Data

US 2008/0278053 A1 Nov. 13, 2008

(30) Foreign Application Priority Data

Jan. 27, 2004 (JP) ..... 2004-019015

(51) Int. Cl.
*F02M 57/06* (2006.01)
*F02P 13/00* (2006.01)
*H01T 13/20* (2006.01)

(52) U.S. Cl. ..... 313/141; 313/118

(58) Field of Classification Search ..... None
See application file for complete search history.

(56) References Cited

U.S. PATENT DOCUMENTS

| | | | | |
|---|---|---|---|---|
| 4,581,558 | A * | 4/1986 | Takamura et al. | 313/141 |
| 4,904,216 | A * | 2/1990 | Kagawa et al. | 445/7 |
| 2002/0130602 | A1 * | 9/2002 | Kanao et al. | 313/141 |

FOREIGN PATENT DOCUMENTS

| | | | |
|---|---|---|---|
| JP | 58-26480 | A | 2/1983 |
| JP | 8-222350 | A | 8/1996 |
| JP | 2002-129268 | A | 5/2002 |
| JP | 2003-105467 | A | 4/2003 |
| JP | 2003-197347 | A | 7/2003 |

* cited by examiner

*Primary Examiner*—Toan Ton
*Assistant Examiner*—Britt D Hanley
(74) *Attorney, Agent, or Firm*—Sughrue Mion, PLLC

(57) ABSTRACT

To provide a spark plug in which separation of a tip can be prevented and enough wear resistance can be obtained without increasing the content of nickel in the tip portion, and a use method of the spark plug.

In a spark plug (100) including an outside electrode (10) including an electrode body portion (11) and a tip (12) bonded to the electrode body portion (11), and a center electrode (20), and the tip (12) is opposed to the front end portion of the center electrode (20) through a spark discharge gap (G), the electrode body portion (11) is made of a nickel alloy containing 13 to 18% by mass of Cr, 0.03 to 0.08% by mass of C, 1 to 3.5% by mass of Mo, 0 to 0.8% by mass of Si, Al, Mn and Ti, and 68% by mass or more of Ni, and the tip (12) is made of a platinum alloy containing 0 to 4% by mass of Ni.

9 Claims, 9 Drawing Sheets

SPARK PLUG WITH HIGH DURABILITY

TECHNICAL FIELD

The present invention relates to a spark plug, and particularly relates to a spark plug showing a high durability.

BACKGROUND ART

As a general spark plug, there has been known a spark plug in which a noble metal tip (hereinafter referred to as tip) is welded to a front end of an electrode (center electrode or outside electrode) body so as to extend the life of the spark plug. In such a spark plug, a nickel alloy having nickel as its principal component is typically used for the electrode body. When the tip is simply welded with the electrode body having nickel as its principal component, there is, however, a fear that the tip separates from the electrode body in use so that the durability deteriorates. Therefore, a technique in which nickel is also contained in the tip so as to suppress the separation of the tip is disclosed in the following Patent Document 1. In addition, a technique in which the tip is designed to have a two-layer structure of a low-nickel-content portion and a high-nickel-content portion, and the high-nickel-content portion is welded with an electrode body, is disclosed in the following Patent Document 2.

Patent Document 1: Japanese Patent Laid-Open No. 26480/1983

Patent Document 2: Japanese Patent Laid-Open No. 135081/1986

DISCLOSURE OF THE INVENTION

Problems that the Invention is to Solve

In recent years, there have been requests to spark plugs for performance (wear resistance) to suppress the wear of electrodes in severer use conditions than conventional ones. These requests cannot be satisfied only by adjusting the content of nickel in the tip as disclosed in the aforementioned Patent Document 1 and the aforementioned Patent Document 2.

That is, an object to prevent the tip from separating can be solved by making the tip contain plenty of nickel which is a principal component of the electrode body. However, increase of the content of nickel in the tip leads to lowering of the melting point of the tip or the like, so that there is a tendency for the wear resistance of the tip to deteriorate. For this reason, it has been proved that there is a case that enough durability can be hardly obtained in severer use conditions.

The present invention was developed in consideration of the aforementioned situation. An object of the present invention is to provide a spark plug in which separation of a tip can be prevented without increasing the content of nickel in the tip, and enough wear resistance can be obtained.

Means for Solving the Problems

To this end, the present inventors reviewed electrode materials forming an electrode body portion of an outside electrode so that the tip could be prevented from separating. As a result, the present inventors found the existence of an electrode body portion capable of preventing the tip from separating and capable of obtaining enough wear resistance when the amounts with which components forming the electrode body portion migrate to the tip, the balance of the components at that time, etc. were taken into consideration as will be described later. Based on this finding, the present invention was completed.

That is, the present invention provides:

(1) A spark plug including an outside electrode including an electrode body portion and a tip bonded to the electrode body portion, and a center electrode opposed to the tip through a spark discharge gap, the spark plug being characterized in that:

the aforementioned electrode body portion is made of a nickel alloy containing 13 to 18% by mass of Cr, 0.03 to 0.08% by mass of C, 1 to 3.5% by mass of Mo, and 68% by mass or more of Ni.

(2) A spark plug according to the aforementioned paragraph (1), characterized in that the aforementioned nickel alloy has a hardness of 185 to 220 Hv.

(3) A spark plug according to the aforementioned paragraph (1) or (2), characterized in that the aforementioned nickel alloy has a pulling strength higher than 120 MPa at 900° C.

(4) A spark plug according to any one of the aforementioned paragraphs (1) through (3), characterized in that the aforementioned nickel alloy has a total content of Si, Al, Mn and Ti not higher than 0.8% by mass.

(5) A spark plug according to any one of the aforementioned paragraphs (1) through (4), characterized in that the aforementioned tip is made of a platinum alloy containing 4% by mass or less of Ni.

(6) A spark plug according to any one of the paragraphs (1) through (5), characterized in that the aforementioned outside electrode is used on the negative side.

EFFECT OF THE INVENTION

According to the spark plug of the present invention, it is possible to obtain enough wear resistance while preventing separation of the tip even when the spark plug is used in severe conditions.

In addition, when the hardness of the nickel alloy is within a predetermined range, the nickel alloy is superior in workability, particularly in cold workability, so that the outside electrode can be processed and positioned accurately. As a result, it is possible to obtain enough wear resistance while preventing separation of the expensive tip.

Further, the present inventors found that under the use conditions requested in recent years, particularly when the outside electrode of the spark plug was used on the negative side, there was a fear that conventional specifications might lead to separation of the tip in some heat cycle conditions.

Since electrode consumption caused by spark discharge is higher on the negative side, various properties of the negative electrode has to be adjusted to have higher wear resistance. In a spark plug in the background art, enough consideration is given to the center electrode because it is a matter of course that the center electrode serves on the negative side and the outside electrode serves on the positive side. In recent years, however, there has been developed such a system that a negative power source is connected to center electrodes in some of plural cylinders in the same manner as in the background art, but the negative power source is connected to outside electrodes in the other cylinders. That is, in some spark plugs, their outside electrodes serve on the negative side, depending on the cylinders the spark plugs are installed. Thus, the spark plugs are used in severer conditions than expected in the background art. When a spark plug according to the present invention is used, it is possible to obtain enough wear resistance while preventing separation of the tip.

DESCRIPTION OF REFERENCE NUMERALS AND SIGNS

Figure 1:
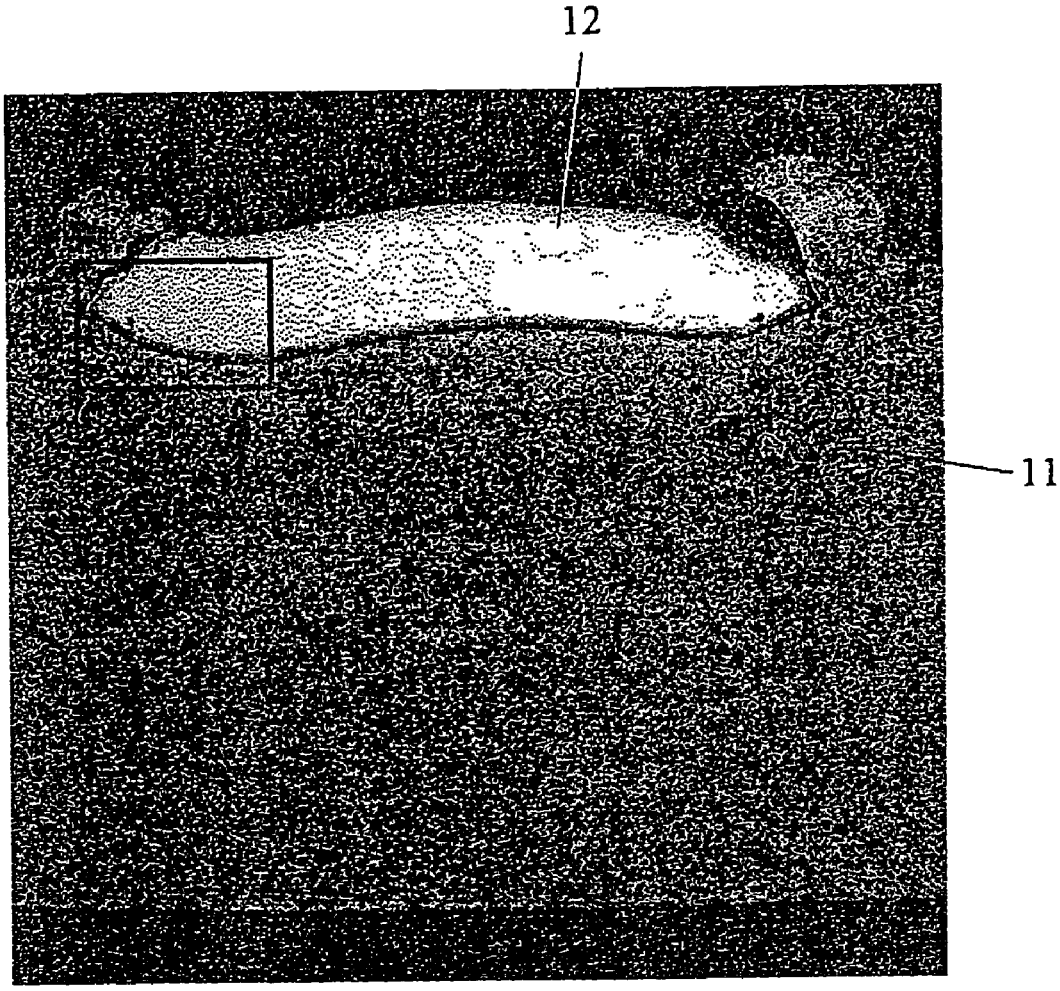
FIG. 1 An explanatory view showing a section of the vicinity of a tip of an outside electrode in an inventive product (Example 1) with 20-times magnification.

100; spark plug, 10; outside electrode, 11; electrode body portion of outside electrode, 12; outside electrode tip, 20; center electrode, 21; center electrode tip, 221 and 222; conductive glass, 23; resistor; 24; terminal electrode, 30; auxiliary electrode, 40; insulator, 50; metal shell, 51; threaded portion to be attached to internal combustion engine, 52; crimping portion, 611 and 612; sealant, 62; talc, P1; front end surface of center electrode, P2; side surface of center electrode, and P3; half section.

BEST MODE FOR CARRYING OUT THE INVENTION

The present invention will be described below in detail.

[1] Spark Plug (1) Electrode Materials (Nickel Alloy and Platinum Alloy)

In a spark plug according to the present invention, an electrode body portion of an outside electrode is made of a nickel alloy having 13 to 18% by mass of Cr, 0.03 to 0.08% by mass of C, 1 to 3.5% by mass of Mo, and 68% by mass or more of Ni.

The aforementioned "nickel alloy" forms an electrode body portion of an outside electrode. Of elements contained in the nickel alloy, the aforementioned "Cr" can form an oxide film in the electrode body portion. The content of Cr is 13 to 18% by mass (preferably 15 to 17% by mass). When the content of Cr is lower than 13% by mass, it is difficult to obtain the effect of the content of Cr, so that the oxidation resistance deteriorates. Thus, there is a tendency for oxidation to advance from the interface between the electrode body portion and the tip easily and gradually with use. Therefore, the tip is apt to separate from the electrode body portion. On the contrary, when the content of Cr exceeds 18% by mass, the electrode body portion becomes so hard that there is a tendency for the workability to deteriorate. In addition, the thermal conductivity is excessively lowered so that sufficient heat release from the electrode body portion cannot be obtained. Thus, the temperature of the tip is apt to increase so that the wear resistance (for example, the survival rate or the like shown in Examples) deteriorates. Incidentally, the content of Cr is measured by electron probe microanalyzer analysis using a wavelength dispersive X-ray spectrometer (hereinafter referred to as "WDS analysis" simply).

In addition, the aforementioned "C" can enhance the high temperature strength of the electrode body portion, and is effective in prevention of separation of the tip due to thermal stress. The content of C is 0.03 to 0.08% by mass (preferably 0.04 to 0.07% by mass). When the content of C is lower than 0.03% by mass, there is a tendency to make it difficult to obtain the effect of enhancing the high temperature strength due to the content of C. On the contrary, when the content of C exceeds 0.08% by mass, the electrode body portion becomes so hard that there is a tendency for the workability (particularly the cold workability) to deteriorate. Incidentally, the content of C is measured by infrared-absorbing analysis.

Further, the aforementioned "Mo" can enhance the high temperature strength and the high temperature oxidation resistance of the electrode body portion. The content of Mo is 1 to 3.5% by mass (preferably 2 to 3% by mass). When the content of Mo is lower than 1% by mass, there is a tendency to make it difficult to obtain the effect of enhancing the high temperature strength (preventing separation of the tip due to thermal stress) due to the content of Mo. In addition, there is a tendency for components of the nickel alloy not to be diffused sufficiently into the tip, so that the bonding strength with which the tip is bonded by welding cannot be secured sufficiently. On the contrary, when the content of Mo exceeds 3.5% by mass, the nickel alloy becomes so hard that there is a tendency for the workability (particularly the cold workability) to deteriorate. Incidentally, the content of Mo is measured by WDS analysis.

Further, the aforementioned "Ni" serves as a chief component of this nickel alloy, and the content of Ni is not lower than 68% by mass (preferably not lower than 72% by mass and not higher than 82% by mass). Incidentally, the content of Ni is measured by WDS analysis.

In addition, it is preferable that the total content of Si, Al, Mn and Ti is made not higher than 0.8% by mass in the electrode body portion. Generally, when these elements as residues of deoxidizer are contained, oxides incapable of plastic deformation are formed in the interface between the tip and the nickel alloy at the time of bonding. In addition, such oxides are also formed in a protective oxide film in use. It is believed that these oxides will cause separation of the tip due to thermal stress. When the total content of these elements exceeds 0.8% by mass, there is a tendency to make it difficult to obtain the effect of the other elements on the oxidation resistance. Thus, oxidation advances from the interface between the electrode body portion and the tip gradually in use so that the tip is apt to separate from the electrode body portion. Further, it is preferable that the content of each of Si, Al, Mn and Ti is not higher than 0.35% by mass. Incidentally, the contents of Si, Al, Mn and Ti are measured by atomic absorption spectrometry.

This nickel alloy may contain other elements than the aforementioned elements Ni, Cr, C, Mo, Si, Al, Mn and Ti. One of the other elements is Fe. Fe is an element having an effect of addition on processing and manufacturing the nickel alloy. The content of Fe is not limited especially, but the content of Fe is preferably 5 to 12% by mass (more preferably 6 to 10% by mass). When the content of Fe is within this range, it is possible to obtain the effect of the content of Fe, particularly enough high temperature strength. Incidentally, the content of Fe is measured by WDS analysis.

Other examples of the other elements include Nb, Ta, W, etc.

It is preferable that the total content of these other elements is made not higher than 2% by mass (excluding 0% by mass). When the total content of the other elements exceeds 2% by mass, the performance required as the nickel alloy in the present invention is hardly exerted sufficiently.

Only one kind of these other elements (Fe, Nb, Ta, W, etc.) may be contained, or two or more kinds thereof may be contained.

In addition, the hardness of this nickel alloy at 25° C. is preferably 185 to 220 Hv (more preferably 200 to 220 Hv) in the aforementioned composition range. When the hardness is within this range, especially high bonding strength by welding can be obtained, and workability (particularly cold workability) is also especially excellent. Thus, a precise outside electrode can be formed. As a result, the obtained spark plug can obtain sufficient wear resistance while preventing separation of the tip.

Further, it is preferably that the pulling strength of this nickel alloy at 900° C. is not lower than 125 MPa in the aforementioned composition range. When the pulling strength is within this range, the obtained outside electrode can obtain sufficient wear resistance while preventing separation of the tip.

On the other hand, it is preferable that the tip is made of a platinum alloy in which the content of Ni is not higher than 4% by mass. The content of Ni can improve the bonding property with the nickel alloy forming the electrode body portion as described previously. When the content of Ni exceeds 4% by mass, the heat resistance of the tip may be apt to deteriorate so that enough wear resistance cannot be obtained. Therefore, it is not preferable that the content of Ni exceeds 4% by mass. Incidentally, the content of Ni is measured by WDS analysis.

In addition, this platinum alloy generally contains other elements than Pt and Ni. The other noble metal elements may include various noble metal elements (Ir, Ru, Rh, etc.). Only one kind of these other elements may be contained, or two or more kinds thereof may be contained. In addition, it is preferable that the total content of these other elements is made not higher than 40% by mass (excluding 0% by mass). When the total content of these other elements exceeds 40% by mass, the performance required as the platinum alloy in the present invention is hardly exerted sufficiently.

Of these other elements, Ir can form a complete solid solution with Pt so as to obtain the effect of increasing the melting point of the Pt alloy. The content of Ir is not limited especially, but is preferably 5 to 30% by mass (more preferably 10 to 25% by mass). When the content of Ir is within this range, the effect of the content of Ir can be obtained sufficiently, and good workability can be obtained. Incidentally, the content of Ir is measured by WDS analysis.

In addition, the hardness of this Pt alloy is preferably 200 to 500 Hv (more preferably 250 to 400 Hv) at 25° C. in the aforementioned composition range. When the hardness is within this range, especially high bonding strength by welding can be obtained.

Thus, in the case of a predetermined nickel alloy forming the electrode body portion as described above, the tip can be prevented from separating, and enough wear resistance can be obtained. It is believed that this depends particularly on a predetermined content of Mo. With increase in temperature of the nickel alloy forming the electrode body portion in use, diffusion coefficients of the components of the nickel alloy increase. Thus, it is observed that the components of the nickel alloy are diffused gradually into the Pt alloy forming the tip. The atomic radius of Mo is large, and Mo forms a solid solution with Ni. Therefore, it is believed that Mo produces strain in the lattice of the Ni alloy so as to further accelerate the diffusion of the additional elements.

At the same time, it was also observed that there occurred a variation in the interface between the electrode body portion and the tip due to this change of the diffusion condition. It was proved that, mainly when Mo is not contained sufficiently, the variation leaded to a gap in the interface between the electrode body portion and the tip gradually due to thermal stress in use and finally caused separation of the tip (see FIG. 2, FIG. 4 and FIG. 6). On the other hand, when Mo was contained within a predetermined range, intercrystalline cracks (a large number of microscopic cracks) occurred in the tip (for example, about 20 to 30 μm distant from the interface between the electrode body portion and the tip toward the tip), but thereafter no large change occurred, and no separation could not be recognized in the tip (see FIG. 1, FIG. 3 and FIG. 5). Accordingly, it can be considered that Mo increases the diffusion speed of each additional element to thereby form the intercrystalline cracks, which absorb thermal stress well, and this is a factor in preventing separation of the tip in the product according to the present invention.

The size and number of these intercrystalline cracks are not limited especially. Generally when the length thereof is about 10 to 50 μm and about 1 to 5 cracks are observed in an area 50 μm square, separation of the tip can be prevented sufficiently.

(2) Structure of Vicinity of Electrodes

The spark plug according to the present invention includes an outside electrode including an electrode body portion and a noble metal tip bonded to the electrode body portion, and a center electrode opposed to the noble metal tip through a spark discharge gap.

Figure 9:
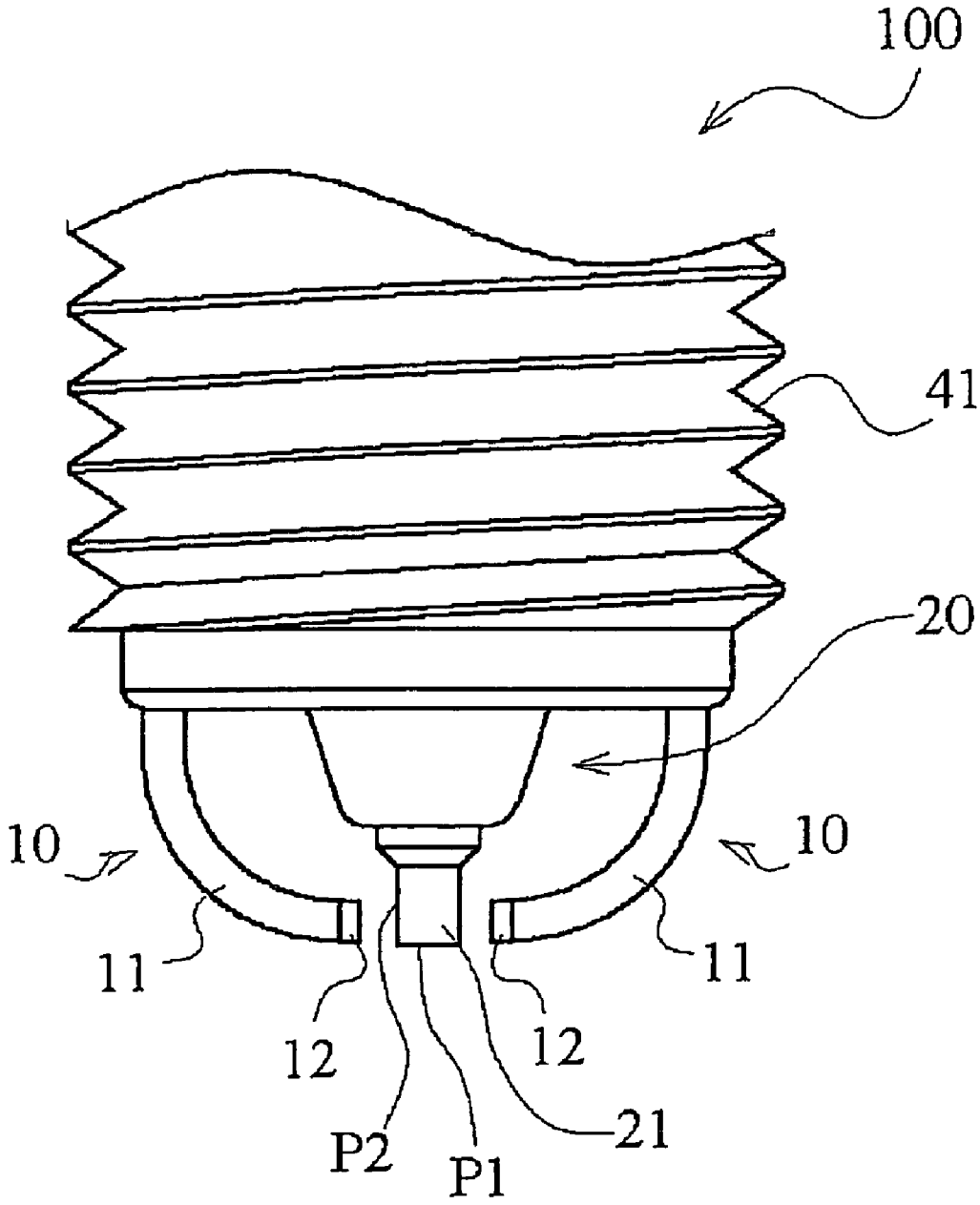
FIG. 9 An explanatory view showing another example of the vicinity of the electrodes of the spark plug according to the present invention with magnification.
Figure 10:
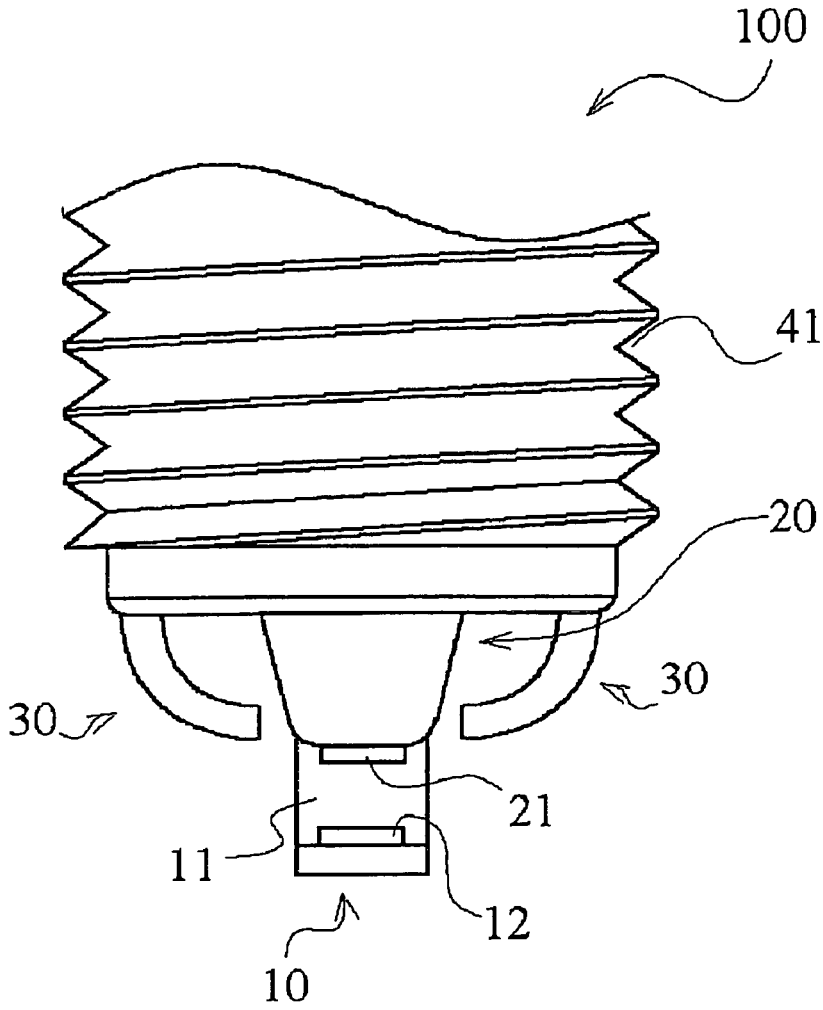
FIG. 10 An explanatory view showing further another example of the vicinity of the electrodes of the spark plug according to the present invention with magnification.

The aforementioned "outside electrode" includes an electrode body portion (11) made of a nickel alloy, and a tip (12) made of a platinum alloy. As for this outside electrode (10), only one outside electrode (for example, FIG. 7 and FIG. 8) may be provided, or two or more outside electrodes (for example, FIG. 9) may be provided. Further, as shown in FIG. 10, one outside electrode (10) according to the present invention is provided, and an auxiliary electrode (30) made of another material may be provided.

The aforementioned "electrode body portion" is a part supporting the tip (12). Generally, the electrode body portion is provided to extend from a metal shell (50) (see FIGS. 7 to 10) which will be described later. Incidentally, the electrode body portion and the metal shell may be formed separately and then bonded to each other, or may be formed integrally.

Figure 8:
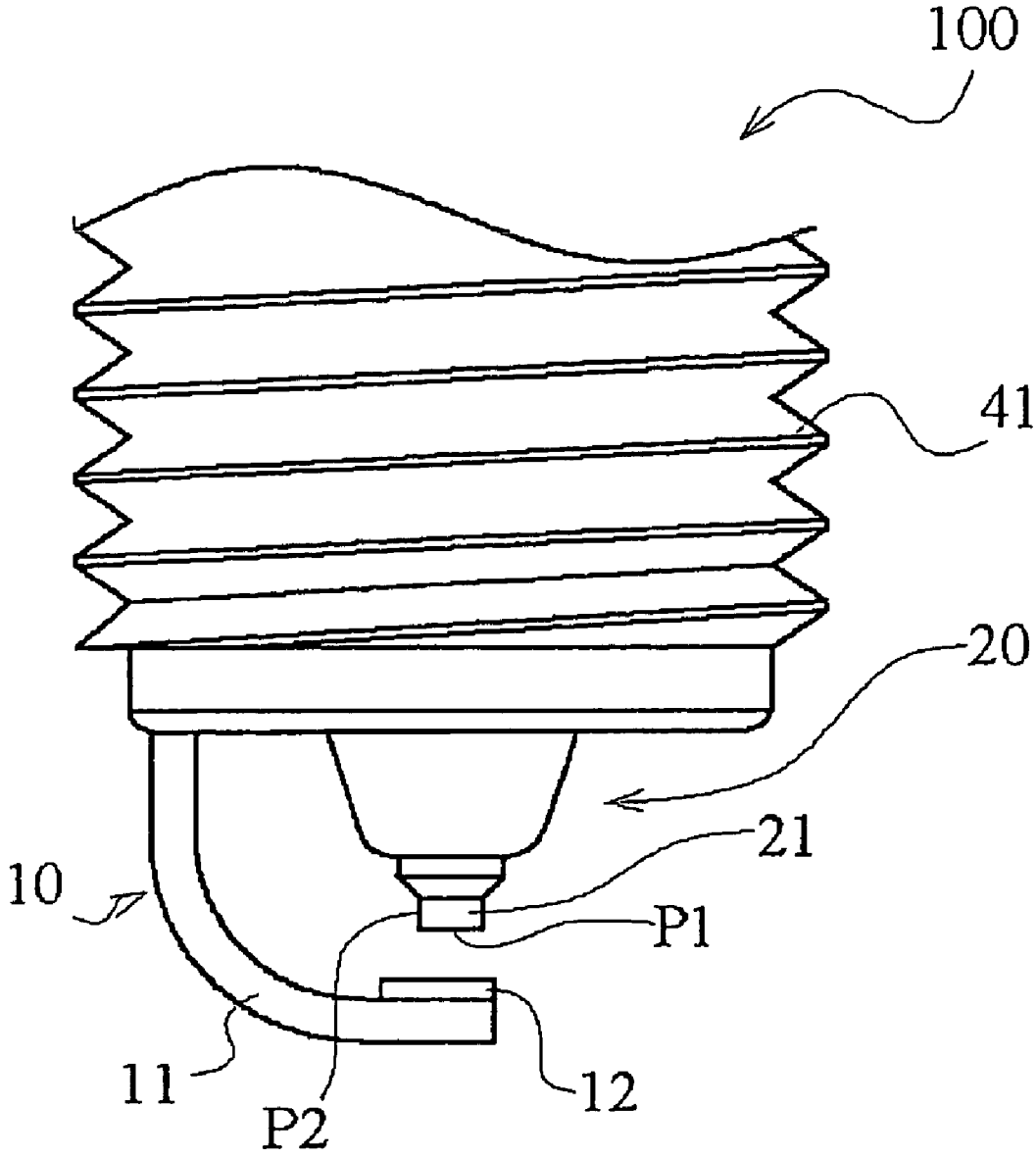
FIG. 8 An explanatory view showing an example of the vicinity of electrodes of the spark plug according to the present invention with magnification.

The aforementioned "tip" is disposed in the front end portion of the electrode body portion (11) of the outside electrode (10) so as to be opposed to a center electrode (20). As for the tip (12), only one tip may be provided for one body portion, or two or more tips may be provided for one body portion. In addition, this tip (12) is opposed to the center electrode (20)

through a spark discharge gap (G). The aforementioned "opposed" means a position relationship in which the center electrode (center electrode tip when a center electrode tip (21) is provided as will be described later) and the tip (outside electrode tip) can be connected by a virtual straight line passing through the space (spark discharge gap). In other words, such a position relationship that any position of the surface of the center electrode and any position of the surface of the tip cannot be connected directly by a virtual straight line due to interference of foreign matter disposed therebetween is excluded. When such a position relationship is excluded, the mutual position relationship is not limited especially. For example, the tip may be opposed (at least partially opposed) to a front end surface (P1) of the center electrode as shown in FIG. 8, or may be opposed (at least partially opposed) to a side surface (P2) of the center electrode as shown in FIG. 9.

The shape of this tip (outside electrode tip) is not limited especially. The tip can be formed into a disc-like shape, a rectangular parallelepiped shape, a cubic shape or the like. In addition, it is preferable that the size of the tip is suited to the specification of the internal combustion engine. It is preferable that the surface area of the largest surface (largest surface opposed to the center electrode) is not smaller than 0.5 $mm^2$ (the upper limit thereof is not limited especially, but is about 3 $m^2$ or smaller). In addition, the thickness of the tip is not limited especially, but it is preferable that the thickness of the tip is not thinner than 0.2 mm (the upper limit thereof is not limited especially, but is about 0.6 mm or thinner) from the point of view of wear resistance.

The aforementioned "spark discharge gap" is a space separating the center electrode (21) and the tip (12) from each other. The distance of the spark discharge gap (G) is preferably suited to the specification of the internal combustion engine or the like, but is generally about 0.5 to 1.5 mm.

The aforementioned "center electrode" can be an integral part made of heat-resistant metal or the like, but the center electrode generally includes a tip (21) (hereinafter referred to as "center electrode tip" for the sake of distinction from the tip of the outside electrode) provided in the front end portion thereof and having a noble metal as its principal component in the same manner as the outside electrode (10). The shape of the center electrode tip is not limited especially. The center electrode tip may be formed into a cylindrical shape, a quadratic prism shape, a cubic shape, a disc-like shape, a rectangular parallelepiped shape, or the like. In addition, this center electrode tip may be formed out of any material if it can exert a function as an electrode tip. Although the material is not limited especially, it is generally preferable that the center electrode tip has a noble metal as its principal component. Of noble metals, Ir or Pt is preferred as the principal component. As for an iridium alloy having Ir as its principal component, an iridium alloy containing one kind or two or more kinds of Rh, Pt, Ru, Ni, etc. other than Ir may be used. Further, as for a platinum alloy having Pt as its principal component, a platinum alloy similar to the platinum alloy forming the aforementioned tip of the outside electrode may be used.

(3) Structure of Spark Plug

Figure 7:
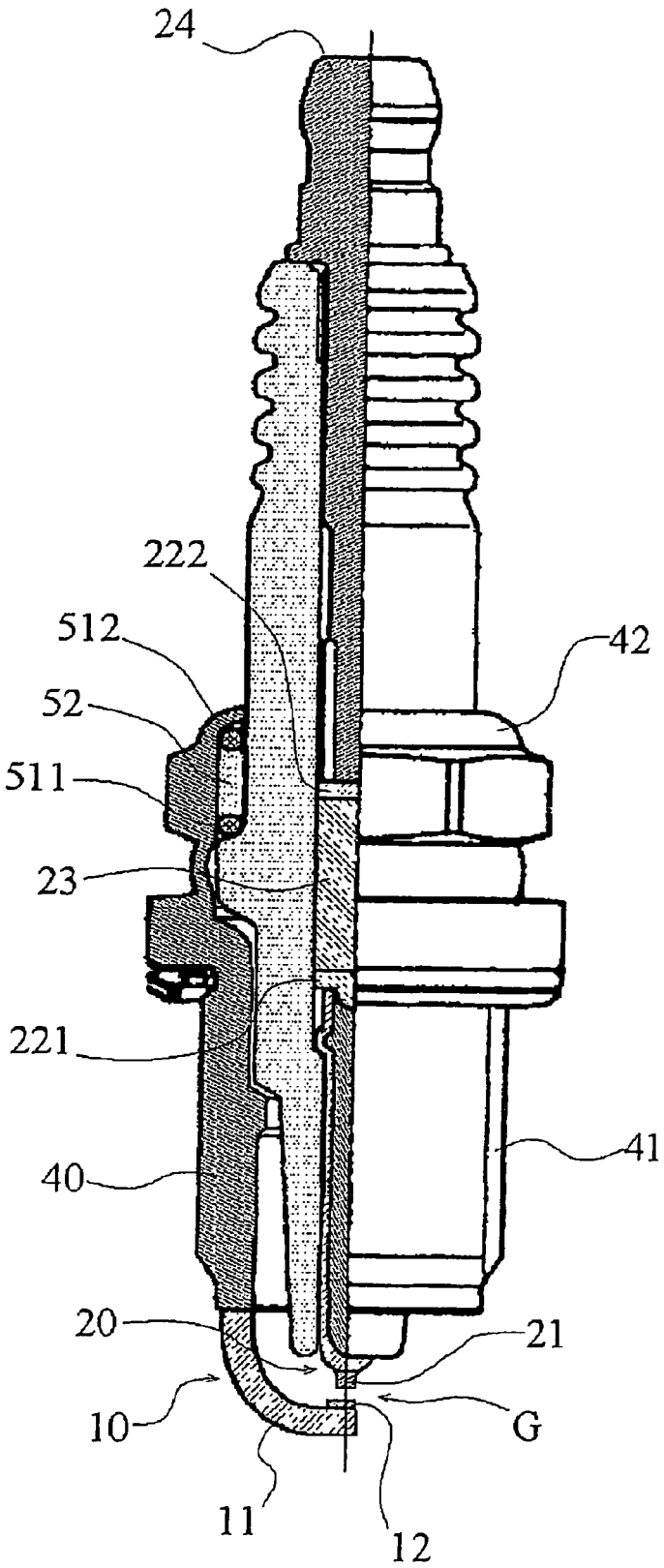
FIG. 7 A partially sectional view schematically showing an example of a spark plug according to the present invention.

Although the spark plug according to the present invention has the structure near the electrodes as described above, no special limitation is placed on the other structure thereof so that a known structure can be used suitably. That is, for example, as shown in FIG. 7, the center electrode (20), a terminal electrode (24), etc. can be provided in a through hole of an insulator (40). In addition, the metal shell (50) formed out of carbon steel (JIS-G3507) or the like can be provided in the outer circumference of the insulator (40). The outside electrode (10) can be provided to extend from the metal shell (50) as described previously.

(4) Usage of Spark Plug

The usage of the spark plug according to the present invention is not limited especially. That is, polarities or the like at the time of a spark are not limited especially. Accordingly, the outside electrode can be used only as a ground electrode (positive electrode) in the same manner as in the background art. However, the spark plug according to the present invention can show its performance (separation resistance, wear resistance, etc.) particularly when this outside electrode is used on the negative side.

For example, assume that the outside electrode is used as a negative electrode, the number of rotations 5,000 rpm is kept over 400 hours, and the highest temperature of the tip (12) of the outside electrode reaches 950° C. Even in such a case, the outside electrode tip portion is not separated, but the ratio of residues which will be described later can be kept to be not lower than 50% (further not lower than 60%, more particularly not lower than 65%).

EXAMPLES

The present invention will be made below more in detail with reference to Examples and the drawings.

[1] Evaluation of Spark Plug (1) Manufacturing of Spark Plug

An assembly in which a center electrode (20), a conductive glass (221), a resistor (23), a conductive glass (222) and a terminal electrode (24) were installed in a through hole of an insulator (40) in that order was prepared. The center electrode (20) had a configuration in which a tip made of a platinum alloy was laser-welded to a front end of the center electrode (20). This assembly was inserted into a cylindrical metal shell (50) and locked therein through a packing material. The cylindrical metal shell (50) had an internal combustion engine mounting threaded portion (51) cut in the outer circumference. After that, a crimping portion (52) in a rear end portion of the metal shell (50) is crimped through packing materials (611 and 612) and a talc (62) so as to fix the assembly into the metal shell (50).

Next, a one end surface of a rod-like body made of each nickel alloy shown in the following Table 1 and formed into a rectangular shape measuring 1.6 mm by 2.8 mm in section was bonded to an annular end surface of the metal shell (50) by electric resistance welding. The rod-like body would serve as an electrode body portion (11) of an outside electrode (10). After that, a tip made of each platinum alloy shown in the following Table 1 and measuring 1.0 mm in diameter and 0.5 mm in height was bonded to the other end of the electrode body portion (11) bonded to the metal shell (50) by electric resistance welding. This electric resistance welding was performed with 10 cycles of current conduction of 60 Hz AC having a current value 900 A while pressure of 34 $kg/cm^2$ was applied. After that, the body portion (11) of the outside electrode was bent by a bending machine so that the outside electrode tip (12) and the center electrode tip (21) are opposed to each other. Thus, a spark discharge gap (G) was formed, and a spark plug (100) was obtained.

TABLE 1

| | | body portion components | | | | | | | | | | | tip portion component | | |
|---|---|---|---|---|---|---|---|---|---|---|---|---|---|---|---|
| | | composition ratio (% by mass, balance is Ni) | | | | | | | | total of Si, Mn, Al | hardness | pulling strength | composition ratio (% by mass) | | |
| | | Cr | Fe | C | Mo | Si | Mn | Al | Ti | and Ti | (Hv) | (MPa) | Pt | Ir | Ni |
| Example | 1 | 16 | 7 | 0.04 | 2 | 0.20 | 0.25 | 0.20 | 0.10 | 0.75 | 200 | 130 | 80 | 20 | 0 |
| | 2 | | | | | | | | | | | | 78 | 20 | 2 |
| | 3 | | | | | | | | | | | | 77 | 20 | 3 |
| | 4 | | | | | | | | | | 240 | 140 | | | |
| | 5 | | | | | | | | | | 180 | 130 | 80 | 20 | 0 |
| | 6 | | | | | | | | | | 185 | 130 | | | |
| | 7 | | | | | | | | | | 220 | 130 | | | |
| Comparison | *1 | *10 | 7 | 0.04 | 2 | 0.20 | 0.25 | 0.20 | 0.10 | 0.75 | 180 | 120 | 80 | 20 | 0 |
| | *2 | *22 | | | | | | | | | 225 | 95 | | | |
| | *3 | 16 | 7 | *0.02 | 2 | 0.20 | 0.25 | 0.20 | 0.10 | 0.75 | 170 | 90 | | | |
| | *4 | | | *0.1 | | | | | | | 250 | 140 | | | |
| | *5 | 16 | 7 | 0.04 | *0.4 | 0.20 | 0.25 | 0.20 | 0.10 | 0.75 | 190 | 100 | | | |
| | *6 | | | | *4 | | | | | | 245 | 155 | | | |
| | *7 | 16 | 7 | 0.04 | 2 | 0.30 | 0.30 | 0.20 | 0.30 | *1.10 | 200 | 130 | | | |
| | *8 | 16 | 7 | 0.04 | 2 | 0.20 | 0.25 | 0.20 | 0.10 | 0.75 | 200 | 130 | 90 | 0 | *10 |
| | *9 | 15 | 8 | 0.04 | *0 | 0.25 | 0.30 | 0.20 | 0.25 | *0.95 | 180 | 100 | 80 | 20 | 0 |
| | *10 | | | | | | | | | | | | 90 | 0 | *10 |

*in the table designates an item which is out of the present invention.

(2) Evaluation of Cold Workability

When the spark discharge gap was formed in the aforementioned chapter (1), the rod-like body which would serve as the electrode body portion (11) of the outside electrode (10) was plastically deformed by bending. After that, evaluation was made in accordance with the following criteria using a scattering (Cp) calculated by the following expression, and the result thereof was shown in Table 2. In addition, this evaluation was performed on 30 spark plugs in each of Examples and Comparative Examples.

scattering (Cp)=drawing tolerance/(6× standard deviation)

| | | |
|---|---|---|
| criteria: | spark plug of Cp ≧ 1.67 | . . . "○" |
| | spark plug of 1.33 ≦ Cp < 1.67 | . . . "Δ" |
| | spark plug of Cp < 1.33 | . . . "x" |

TABLE 2

| | | tip portion welding strength | tip portion survival rate | cold workability |
|---|---|---|---|---|
| Example | 1 | ○ | ○ | ○ |
| | 2 | ○ | ○ | ○ |
| | 3 | ○ | ○ | ○ |
| | 4 | ○ | ○ | Δ |
| | 5 | Δ | ○ | ○ |
| | 6 | ○ | ○ | ○ |
| | 7 | ○ | ○ | ○ |
| Comparison | *1 | x | ○ | ○ |
| | *2 | ○ | Δ | x |
| | *3 | x | ○ | ○ |
| | *4 | ○ | ○ | x |
| | *5 | x | ○ | ○ |
| | *6 | ○ | ○ | x |
| | *7 | x | ○ | ○ |
| | *8 | ○ | x | ○ |
| | *9 | x | ○ | ○ |
| | *10 | ○ | x | ○ |

(3) Evaluation of Welding Strength of Outside Electrode Tip Portion

After the cold workability in the aforementioned chapter (2) was evaluated, the spark discharge gap was adjusted to 0.9 mm. After that, each spark plug was attached to a 4-cylinder 2.0-liter gasoline engine, and the following durability test was performed thereon. After that, the welding strength of the outside electrode tip portion was evaluated in accordance with the following criteria. The result of the evaluation was included in Table 2. The durability test was performed on each spark plug in such a manner that the following cycle was repeated for 200 hours. That is, in each cycle, the engine speed was kept at 5,000 rpm for 1 minute, and idling was carried out for 1 minute. In addition, a negative electrode was used as a power source for supplying power to the spark plug. That is, the outside electrode was made to function as a positive electrode. Incidentally, the highest temperature in the outside electrode tip portion (12) was 950° C. (at the time of 5,000 rpm), and the lowest temperature was 400° C. (at the time of idling).

criteria: spark plug with tip (12) surviving . . . "○"
spark plug with tip (12) separated partially . . . "Δ"
spark plug with tip (12) separated completely . . . "x"

(4) Evaluation of Surviving Rate of Tip Portion After Durability Test

Figure 11:
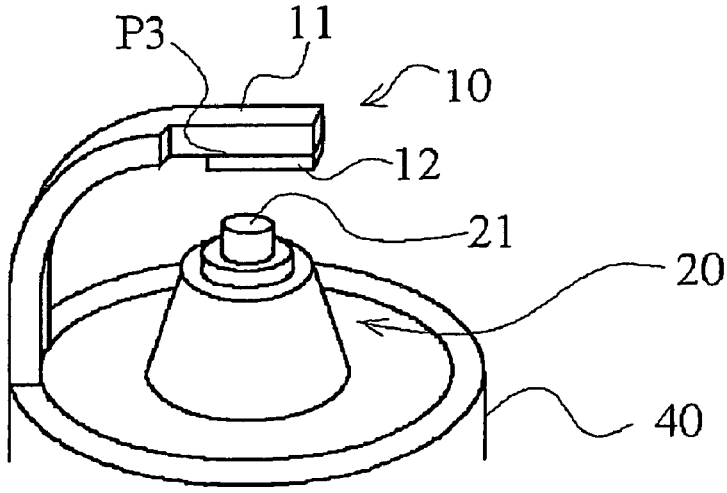
FIG. 11 An explanatory view for explaining the spark plug when the survival rate of a tip in examples is measured.

After the cold workability in the aforementioned chapter (2) was evaluated, the spark discharge gap was adjusted to 0.9 mm. After that, each spark plug was attached to a 6-cylinder 2.0-liter gasoline engine, and the following durability test was performed thereon. After that, the outside electrode was cut so that a half section (P3) obtained by substantially cutting off a half of the tip portion was exposed, as shown in FIG. 11. The exposed sectional area of the tip (12) was calculated. Next, a residual ratio "S" to the sectional area (0.39 $mm^2$) of the tip portion before durability was calculated so that evaluation was made on the S in accordance with the following criteria. The result of the evaluation was included in Table 2. The durability test was performed on each spark plug for 400 hours while the engine speed was kept at 5,000 rpm. In addition, a positive electrode was used as a power source for supplying power to the spark plug. That is, the outside electrode was made to function as a negative electrode. Incidentally, the highest temperature in the center electrode tip portion (21) was 850° C., and the highest temperature in the outside electrode tip portion (12) was 950° C.

criteria: spark plug with S>65% . . . "○"
spark plug with 50%<S<65% . . . "Δ"
spark plug with S<50% . . . "x"

(5) Evaluation of Interface Between Body Portion and Tip Portion

After the same durability test as that for evaluating the welding strength of the outside electrode tip in the aforementioned chapter (3) was performed for 50 hours on the spark plug in Example 1 and the spark plug in Comparative Example 9 in Table 1. After that, the outside electrode of each spark plug was cut to expose a half section similar to that in the aforementioned chapter (4). Next, electrolytic etching was performed on the electrode body portion of the half section surface in an acid solution so that the boundary between the electrode body portion (11) of the outside electrode and the tip (12) of the outside electrode could be recognized visually. After that, images in which the half section after etching was magnified 20 times were obtained respectively. Explanatory views using the images were shown in FIG. 1 (Example 1) and FIG. 2 (Comparative Example 9). In addition, explanatory views using the images in which the parts surrounded by rectangular frames in FIG. 1 and FIG. 2 were magnified 400 times respectively were shown in FIG. 3 (Example 1) and FIG. 4 (Comparative Example 9).

(6) Effect of Examples

From Table 1 and Table 2, separation of the tip portion in the welding strength test was recognized in Comparative Example 1 because the content of Cr was lower than its lower limit value. In Comparative Example 2, the cold workability deteriorated and the scattering in discharge gap increased because the content of Cr was higher than its upper limit value. In addition, the lowering of the survival rate was recognized because the thermal conductivity deteriorated. In Comparative Example 3, the content of C was lower than its lower limit value so that the effect of enhancing the high temperature strength could not be obtained. Thus, separation of the tip portion in the welding strength test was recognized. In Comparative Example 4, the content of C was higher than its upper limit value so that the cold workability deteriorated. Thus, the scattering in discharge gap increased. In Comparative Example 5, the content of Mo was lower than its lower limit value. Thus, separation of the tip portion was recognized in the welding strength test. In Comparative Example 6, the content of Mo was higher than its upper limit value so that the cold workability deteriorated. Thus, the scattering in discharge gap increased. In Comparative Example 7, the total content of Si, Al, Mn and Ti was higher than its upper limit value so that the effect of oxidation resistance could not be obtained. Thus, separation of the tip portion was recognized in the welding strength test. In Comparative Example 8, a platinum alloy whose Ni content was higher than its upper limit value was used for the tip portion. Therefore, enough welding strength was obtained, but the survival rate of the tip portion deteriorated. In Comparative Example 9, Mo was not contained, and the total content of Si, Al, Mn and Ti was higher than its upper limit value so that the effect of oxidation resistance could not be obtained. Thus, separation of the tip portion was recognized in the welding strength test. In Comparative Example 10, a platinum alloy whose Ni content was higher than its upper limit value was used for the tip portion. Therefore, enough welding strength was obtained, but the survival rate of the tip portion deteriorated. Incidentally, a nickel alloy used in Comparative Example 9 and Comparative Example 10 was Inconel (registered trademark) often used in the background art.

In contrast with the aforementioned respective Comparative Examples, in each of Examples 1 to 7, both the nickel alloy used for the body portion and the platinum alloy used for the tip portion are within their corresponding ranges according to the present invention. Accordingly, well-balanced excellent results were obtained as to the welding strength, the survival rate and the cold workability. In Example 4, the hardness exceeded 220 Hv so that the cold workability deteriorated slightly. Thus, a slight scattering was recognized, but within an allowable range. In addition, in Example 5, the hardness was lower than 185 Hv so that the slight lowering of the welding strength was recognized, but the lowering was so slight that there was no problem for use. In Examples 1 to 3, 6 and 7, the hardness was within its preferable range so that separation of the tip could be prevented, and enough wear resistance could be obtained. Further, excellent workability was obtained. In Examples 1 to 7, the pulling strength is not lower than 125 MPa at 900° C. Thus, separation of the tip can be prevented while enough wear resistance can be obtained.

Figure 3:
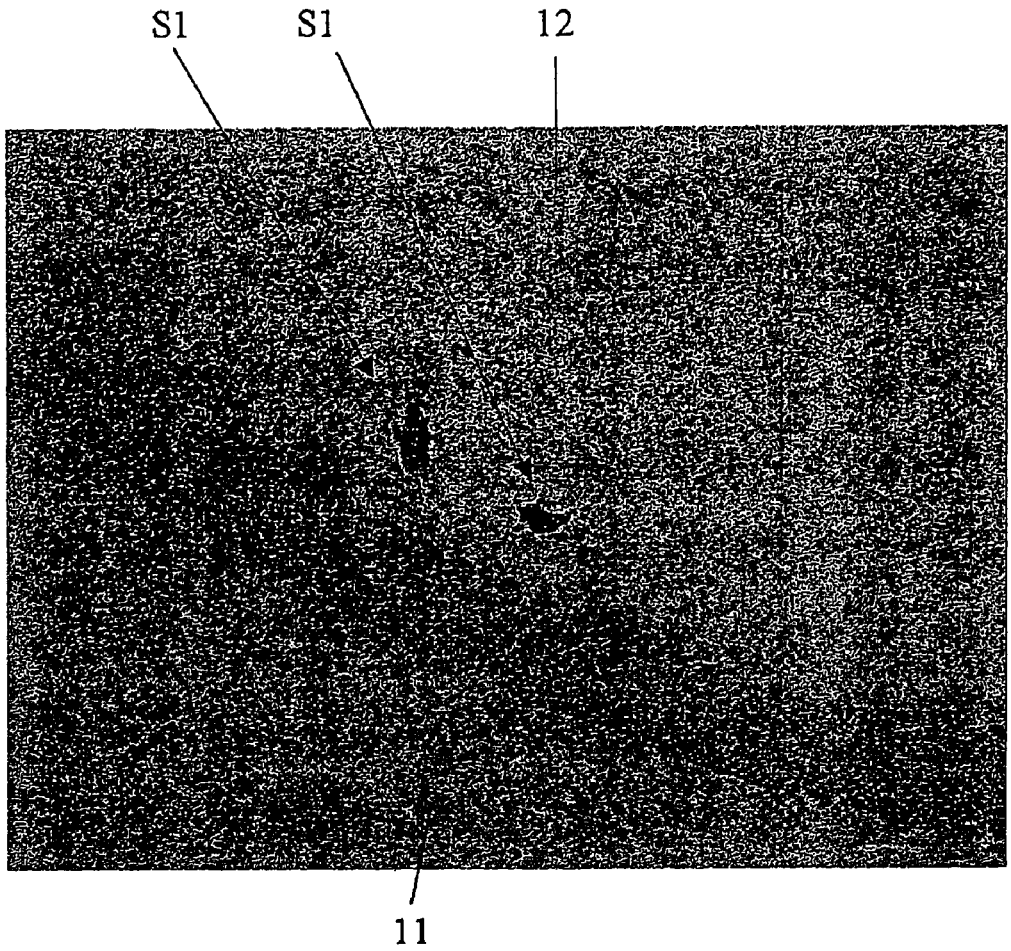
FIG. 3 An explanatory view showing a rectangular region in FIG. 1 (Example 1) with 400-times magnification.
Figure 4:
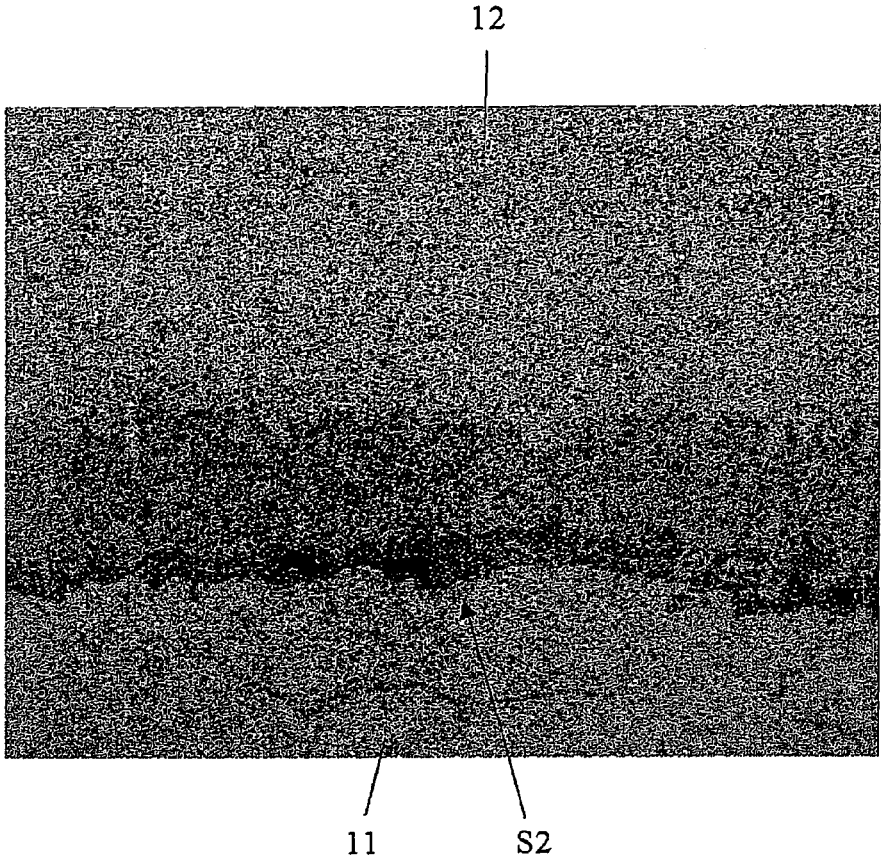
FIG. 4 An explanatory view showing a rectangular region in FIG. 2 (Comparative Example 9) with 400-times magnification.
Figure 5:
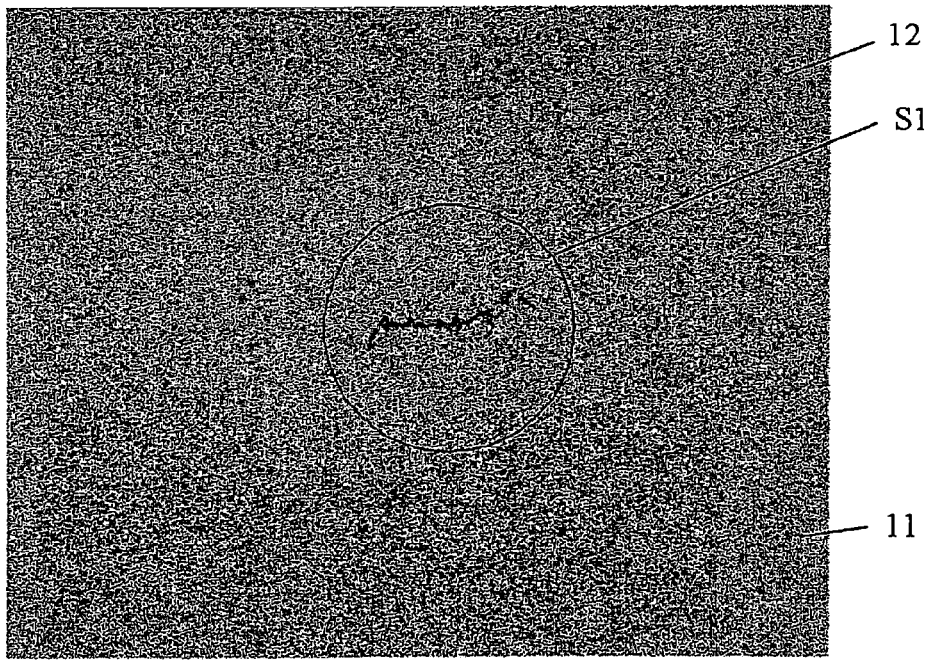
FIG. 5 An explanatory view showing a part of a determination surface of the outside electrode in Example 1 with 400-times magnification.
Figure 6:
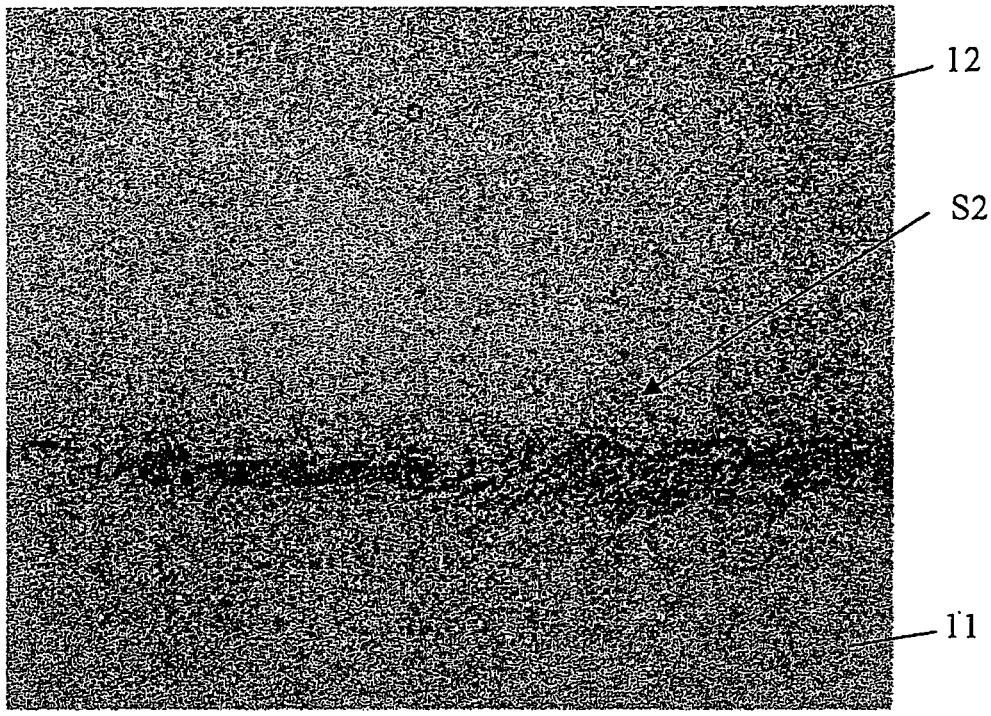
FIG. 6 An explanatory view showing a part of the outside electrode in Comparative Example 9 with 400-times magnification.

On the other hand, FIGS. 1 to 6 are explanatory views for recognizing the separation conditions visually. FIG. 5 is an explanatory view showing a part of the determination surface of the outside electrode in Example 1 with 400-times magnification. In addition, FIG. 6 is an explanatory view showing a part of the outside electrode in Comparative Example 9 with 400-times magnification. As is understood from these explanatory views, intercrystalline cracks (S1) were recognized in FIG. 5. On the other hand, separation (S2) was recognized in FIG. 6. However, the boundary between the electrode body portion (11) of the outside electrode and the tip (12) of the outside electrode cannot be recognized visually in these explanatory views. Therefore, etching was performed as described previously. As a result, the boundary can be recognized visually as shown in FIGS. 1 to 4.

Figure 2:
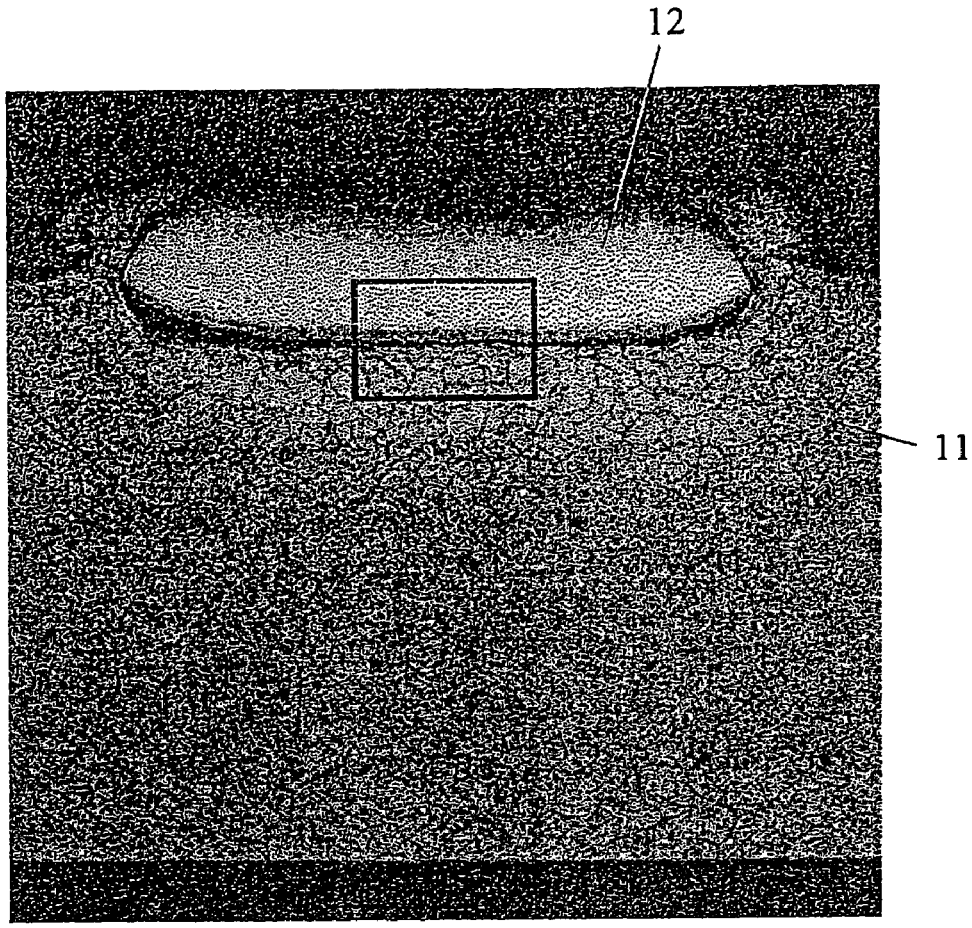
FIG. 2 An explanatory view showing a section of the vicinity of a tip of an outside electrode in a comparative product (Comparative Example 9) with 20-times magnification.

It is understood from FIG. 2 that the tip (12) is released from the electrode body portion (11) in Comparative Example 9. On the other hand, it is understood from FIG. 1 that the electrode body portion (11) and the tip (12) are bonded firmly in the spark plug in Example 1 which is a product according to the present invention. Incidentally, the black belt-like region in FIG. 1 is a boundary region overetched at the time of etching due to its components. It is also understood from FIG. 5 that the region is not separation. In addition, it is understood from FIG. 3 that intercrystalline cracks (at two places) in the tip (12) which cannot be recognized in FIG. 4 are recognized when the interface between the electrode body portion (11) and the tip (12) is observed. These intercrystalline cracks (S1) are not recognized in the boundary (between the body portion and the tip portion) but recognized in the tip portion (12). On the other hand, a scale portion (void portion) caused by separation is recognized in the boundary between the electrode body (11) and the tip (12) in FIG. 4. From these results and in consideration of the fact that the tip was separated in the welding strength test in Comparative Example 9, the intercrystalline cracks (S1) recognized in FIG. 3 can be regarded as factors to prevent separation of the tip (12).

Although the present invention has been described in detail and with reference to its specific embodiments, it is obvious to those skilled in the art that various changes or modifications can be applied to the present invention without departing from the spirit and scope thereof.

The present application is based on a Japanese patent application (Patent Application No. 2004-019015) filed on Jan. 27, 2004, whose contents are incorporated herein by reference.

INDUSTRIAL APPLICABILITY

The present invention can be used broadly in the field concerned with spark plugs. That is, the present invention is applicable to resistor plugs, multipolar type plugs, plugs for agricultural/forestry machines, etc. In addition, the present invention is applicable to GHP plugs, gas engine plugs, etc.

The invention claimed is:

1. A spark plug comprising:

an outside electrode including an electrode body portion and a tip bonded to said electrode body portion; and a center electrode opposed to said tip through a spark discharge gap, wherein said electrode body portion is made of a nickel alloy containing 13 to 18% by mass of Cr, 0.03 to 0.08% by mass of C, 2 to 3% by mass of Mo, and 68% by mass or more of Ni;

said nickel alloy has a total content of Si, Al, Mn and Ti of not higher than 0.75% by mass; and the content of each of Si, Al, Mn and Ti is not higher than 0.35% by mass.

2. The spark plug as claimed in claim 1, wherein said nickel alloy has a hardness of 185 to 220 Hv.

3. The spark plug as claimed in claim 1, wherein said nickel alloy has a pulling strength of higher than 120 MPa at 900° C.

4. The spark plug as claimed in claim 1, wherein said tip is made of a platinum alloy containing Ni, where Ni is present in an amount of 4% by mass or less.

5. The spark plug as claimed in claim 1, wherein said outside electrode is used as a negative electrode.

6. The spark plug as claimed in claim 1, wherein said nickel alloy contains Si, Al and Mn.

7. The spark plug as claimed in claim 6, wherein said nickel alloy contains Ti.

8. The spark plug as claimed in claim 1, wherein said nickel alloy has a hardness of 200 to 220 Hv.

9. The spark plug as claimed in claim 1, wherein said tip is made of a platinum alloy having a hardness of 250-400 Hv.

* * * * *